US007458381B2

(12) United States Patent
Shepard

(10) Patent No.: US 7,458,381 B2
(45) Date of Patent: Dec. 2, 2008

(54) FINGERNAIL POLISH AND REMOVER APPLICATOR

(76) Inventor: Gloria A. Shepard, 3009 Green Acres Dr., Lake Havasu, AZ (US) 86404

( * ) Notice: Subject to any disclaimer, the term of this patent is extended or adjusted under 35 U.S.C. 154(b) by 75 days.

(21) Appl. No.: 11/418,404

(22) Filed: Apr. 5, 2006

(65) Prior Publication Data

US 2007/0235052 A1 Oct. 11, 2007

(51) Int. Cl.
*A45D 29/18* (2006.01)

(52) U.S. Cl. ..... 132/74.5

(58) Field of Classification Search ..... 132/74.5; 401/156, 183, 184, 185, 192, 202, 262, 205
See application file for complete search history.

(56) References Cited

U.S. PATENT DOCUMENTS

| | | | | | |
|---|---|---|---|---|---|
| 373,701 | A * | 11/1887 | Underwood | 401/131 |
| 2,820,233 | A * | 1/1958 | Steiner | 401/183 |
| 2,905,956 | A * | 9/1959 | Fuller et al. | 401/1 |
| 3,061,868 | A * | 11/1962 | Miller | 401/135 |
| 3,128,493 | A * | 4/1964 | Tadeusz | 401/184 |
| 3,337,124 | A * | 8/1967 | De Molin et al. | 417/437 |
| 3,655,290 | A | 4/1972 | Griffith | |
| 3,688,450 | A * | 9/1972 | Brockman | 451/461 |
| 3,885,578 | A | 5/1975 | Hicks | |
| 4,078,865 | A | 3/1978 | Moser | |
| 4,470,715 | A | 9/1984 | Reuchlin et al. | |
| 4,747,419 | A * | 5/1988 | Flynn et al. | 132/73 |
| 4,764,044 | A * | 8/1988 | Konose | 401/150 |
| 5,299,877 | A | 4/1994 | Birden | |
| 5,762,077 | A * | 6/1998 | Griffiths, Jr. | 132/74.5 |
| 6,035,859 | A | 3/2000 | Antonopoulos-McIvor | |
| 6,192,892 | B1 | 2/2001 | Resler | |
| 6,209,548 | B1 * | 4/2001 | Harrison et al. | 132/74.5 |
| 6,328,040 | B1 * | 12/2001 | Stein | 132/74.5 |
| 6,755,380 | B2 | 6/2004 | Pace | |
| 6,782,894 | B2 | 8/2004 | Shum | |

* cited by examiner

*Primary Examiner*—Robyn Doan
*Assistant Examiner*—Rachel A Running

(57) ABSTRACT

A fingernail polish container and applicator includes a cylindrical transparent container having a pump on one end and an angled applicator tip on the other end. Fingernail polish or fingernail polish remover is stored in the container and is forced to and through the applicator tip by operation of the pump.

1 Claim, 1 Drawing Sheet

FINGERNAIL POLISH AND REMOVER APPLICATOR

TECHNICAL FIELD OF THE INVENTION

The present invention relates to the general art of cosmetics, and to the particular field of fingernail polish.

BACKGROUND OF THE INVENTION

Since ancient times, women have decorated their finger nails by applying colored polishes. These polishes, when hardened, gave the finger nails a decorative and appealing appearance. Traditionally, these polishes were available in a few colors which were applied to the finger nails as smooth uniform coatings. A variety of brushes and foam applicators have been used to apply these nail polishes to finger nails. These applicators generally consisted of small bristled brushes having substantially uniform bristles. These applicators were specifically designed to apply the nail polish as uniformly as possible to create a smooth and uniform coating. The end result was a finger nail having a reflective uniform color.

As women's fashions changed, so have attitudes concerning the decorating of finger nails. Nail polishes are now available in a great variety of colors and textures. Fanciful nail decorations have also become very popular. Fingernails have been decorated by uniformly spreading colored coatings over the surface of nails. Conventionally, fingernail polish brushes are mounted in bottle caps, and bristles are held suspended in the coating material.

Applicators constructed integrally with bottle caps are widely known. Examples are brush type applicators mounted in caps such as used in paste jars and in nail polish vials. Glass rod type applicators with enlarged fire polished ends are also known to be mounted in bottle caps. Examples of cap-mounted rod type applicators are found in antiseptic bottles and in perfume vials. Glass rod applicators are intended to carry very small amounts of liquid from containers to body members and to disperse the small quantities of liquid over a general area in an uncontrolled manner. These applicators are often difficult to maneuver and may cause uneven or undesirable application of polish to the fingernails. This can be annoying and may require removal of misapplied polish. For this reason, some women would rather spend time and money for a professional to apply polish to their fingernails, especially if an intricate application is required. This can be wasteful of both time and money.

Furthermore, liquid fingernail polish and similar materials are necessarily of a nature such that they will quickly dry and harden upon any prolonged exposure to the atmosphere. Such materials are conventionally applied, however, by means of a brush element which is either dipped into a separate container of polish as required or has associated therewith some sort of reservoir for the more or less continuous supply of polish to the brush element during use. In either case, it has long presented a problem when the polish material hardens upon the brush during periods between use. Therefore, there is a need for a device which overcomes the problems associated with the hardening of nail polish on a brush.

Furthermore, with bottle containers having brush applicators, the only way a person can apply nail polish is by putting the nail polish container on a sturdy base such as a table. The user will need to unscrew the cap, use the brush to apply the polish, and continuously re-dip to apply to the other nails. This is not convenient or practical when most people do their nails or their daughter's nails in bed, on the sofa, or on the floor. Even when the surface is flat, the likelihood and incidence that the bottle will tip over and nail polish will be spilled is very high.

Furthermore, although most of the innovation in nail polish concerns additives designed to enhance the luster, color, texture and stability of nail polishes, relatively little attention has been devoted toward improved packaging and application methods. Given this lack of attention, the need for certain new and useful improvements directed toward nail color packaging and application methods is evident.

Accordingly, there is a need for a new and improved system for applying color to a surface of a nail. Still further, exposure to heat or the like or due to simple age, the color of fingernail polish may change. This can be very disconcerting if a user believes she is using one color of polish and the actual color is different due to the just-mentioned causes. The polish may have to be removed, which can be very annoying, especially if time is a consideration. Therefore, there is a need for a fingernail polish container which permits a user to be sure of the color of the polish that will be applied before application.

SUMMARY OF THE INVENTION

The above-discussed disadvantages of the prior art are overcome by a fingernail polish container and applicator which includes a cylindrical transparent container having a pump on one end and an angled applicator tip on the other end. Fingernail polish or fingernail polish remover is stored in the container and is forced to and through the applicator tip by operation of the pump.

Using the fingernail polish container and applicator embodying the present invention will permit a user to accurately control application of polish to the fingernails. Application will be precise and there is no danger of a brush drying out or applying the polish in an uneven manner. Still further, there is no danger that the polish or remover will be spilled during use. Furthermore, since the container is transparent, a user can be sure of the color of the polish before she actually applies it to her nails.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
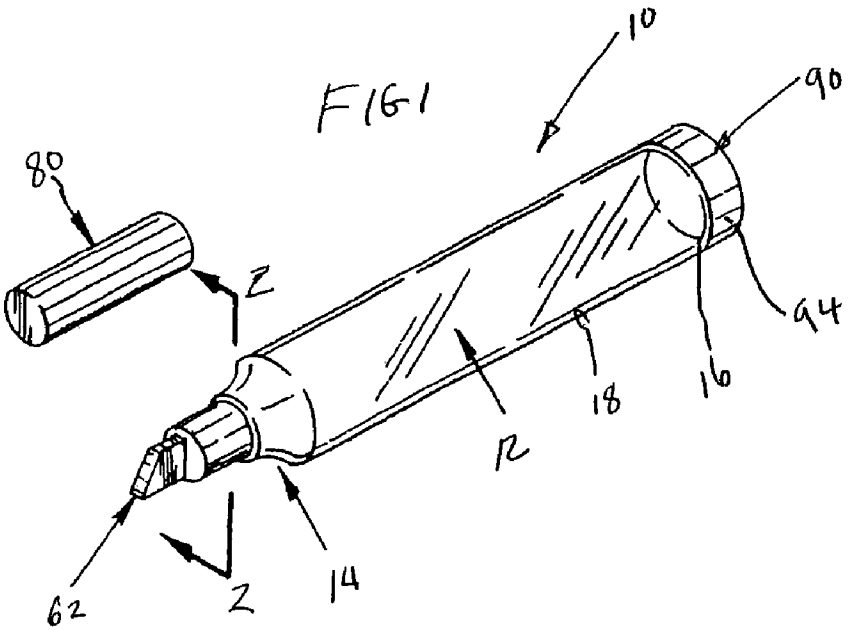
FIG. 1 is a perspective view of a fingernail polish container and applicator embodying the present invention.
Figure 3:
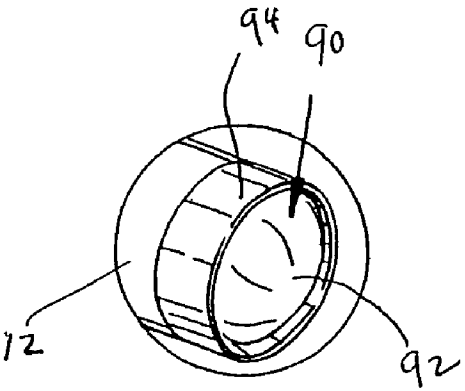
FIG. 3 is a detail view of a pump element on the fingernail polish container and applicator shown in FIG. 1.

Referring to the figures, it can be understood that the present invention is embodied in a container and applicator 10 for applying liquid fingernail polish to a user's nails. Applicator 10 comprises a container 12 which has a first end 14 which is a forward end when the container is in use, a second end 16 which is an aft end when the container is in use and a translucent cylindrical wall 18 which connects first end 14 to second end 16 of the container. An outlet port 20 is defined on first end 14. Gripping teeth 22 are defined on first end 14 adjacent to outlet port 20.

An interior volume 24 is defined by first end 14 and second end 16 and cylindrical wall 18 of the container, and liquid fingernail polish 28 is contained in the interior volume of the container. The translucent nature of the wall allows a user to determine the color of the polish in the container. A dispensing unit 40 includes a cylindrical plug 42 which is frictionally fixed to first end 14 of the container in outlet port 20. Plug 42 has a first end 44 which is a forward end when the plug is fixed in the container and a second end 46 which is an aft end when the plug is fixed in the container. Second end 46 of the plug is located in outlet port 20 and is in fluid communication with interior volume 24 of the container. A fluid passage 48 extends from second end 46 of plug 42 toward first end 44 of the plug and is in fluid communication with interior volume 24 of the container so liquid fingernail polish 28 can flow therethrough.

A counterbore 50 is defined in first end 44 of plug 42 and extends from first end 44 of the plug toward second end 46 of the plug and which is in fluid communication with interior volume 24 of the container via fluid passage 48 in plug 42. Plug 42 has an outer surface 52 and gripping teeth 54 are defined on outer surface 52 of the plug adjacent to second end 46 of the plug. Gripping teeth 54 on the plug engage gripping teeth 22 on the container to hold the plug in position in the outlet port of the container.

A dispensing plug 60 is frictionally mounted in counterbore 50 to be in fluid communication with interior volume 24 of the container via fluid passage 48. Dispensing plug 60 has a first end 62 which is a forward end when the plug is in use, a second end 64 which is an aft end when the plug is in use and which is located in counterbore 50 and which is in fluid communication with interior volume 24 of the container via fluid passage 48 of the cylindrical plug 42 and a longitudinal axis 66 which extends between first end 62 of dispensing plug 60 and second end 64 of the dispensing plug.

First end 62 is an applicator tip and is oriented at an oblique angle θ with respect to longitudinal axis 66 of the dispensing plug. A cap 80 is frictionally engaged with first end 14 of the container in covering relationship to dispensing unit 40 when in use and is removed when liquid fingernail polish is to be dispensed from container and applicator 10.

Figure 2:
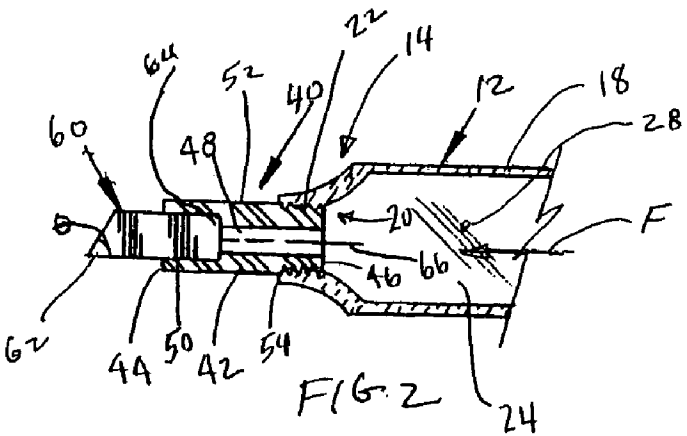
FIG. 2 is a detail view taken along line 2-2 of FIG. 1.

A pump unit 90 is located on second end 16 of container 12. Pump unit 90 includes a flexible element 92 which covers the second end of the container and a ring 94 which surrounds the second end of the container. The flexible element is forced towards the first end of the container to apply pressure to the interior volume of the container and force liquid from the interior volume of the container through applicator tip 62 of the dispensing plug 60 via the outlet port of the container and via the fluid passage 48 of the plug 42 and via the body of the plug 60. Flow direction of the liquid is indicated in FIG. 2 by arrow F.

Use of container and applicator 10 can be understood from the teaching of the foregoing disclosure and thus will be only briefly discussed. A user simply removes the cap from the container, places the applicator tip on her fingernail where desired and operates the pump. Fingernail polish or fingernail polish remover is forced through the applicator tip onto the fingernail in the precise location desired and is then evenly dispensed onto the fingernail. If the pump is manually operated, the overall device is held by the pump whereby operation of the device is easy and convenient. The transparent feature of the container permits a user to be sure of the color of the polish before use whereby any discoloration of the polish either due to age or due to exposure to light or heat will not adversely affect the use of the polish. The angled form of the applicator tip allows precise application of polish to the nails of the user.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A container and applicator for fingernail polish consisting of:

A) a container which has
  (1) an outlet port,
  (2) an interior volume, and
  (3) liquid fingernail polish contained in the container;

B) a dispensing unit which includes
  (1) a plug mounted the container in the outlet port of the container, the plug having
    (a) a fluid passage which is in fluid communication with the interior volume of the container,
    (b) a counterbore which is in fluid communication with the fluid passage in the plug, and
  (2) a dispensing plug mounted in the counterbore to be in fluid communication with the interior volume of the container via the fluid passage, the dispensing plug having
    (a) an angled first end which is a forward end when the plug is in use, and
    (b) a second end which is an aft end when the plug is in use and which is located in the counterbore and which is in fluid communication with the interior volume of the container via the fluid passage of the cylindrical plug; and C) a pump unit on the second end of the container.

* * * * *